US006202907B1

(12) United States Patent
Higgins

(10) Patent No.: US 6,202,907 B1
(45) Date of Patent: Mar. 20, 2001

(54) BACKPACK FRAME AND COT

(76) Inventor: Richard S. Higgins, 1/5 Streeton Pl., Lambton N.S.W 229 (AU)

( * ) Notice: Subject to any disclaimer, the term of this patent is extended or adjusted under 35 U.S.C. 154(b) by 0 days.

(21) Appl. No.: 08/977,091

(22) Filed: Nov. 24, 1997

(51) Int. Cl.[7] ..... A45F 4/06

(52) U.S. Cl. ..... 224/156; 224/153; 224/583; 224/633; 224/635; 5/114

(58) Field of Search ..... 224/153, 154, 224/156, 581, 582, 583, 627, 628, 633, 635, 636, 259, 261, 263; 5/111, 112, 114

(56) References Cited

U.S. PATENT DOCUMENTS

| | | | | |
|---|---|---|---|---|
| 2,964,222 | * | 12/1960 | Rainwater | 224/156 |
| 2,973,888 | * | 3/1961 | Beardsley | 224/156 X |
| 3,464,607 | * | 9/1969 | Grace et al. | 224/156 |
| 3,620,428 | | 11/1971 | Silverthorne . | |
| 3,730,407 | | 5/1973 | Russell . | |
| 3,733,017 | * | 5/1973 | Pletz | 224/636 X |
| 3,828,992 | | 8/1974 | Cerchione . | |
| 3,860,157 | * | 1/1975 | Richards et al. | 224/636 X |
| 3,885,722 | * | 5/1975 | Robertson | 224/261 |
| 3,912,138 | * | 10/1975 | Pava | 224/156 X |
| 4,169,550 | * | 10/1979 | Williams | 224/633 |
| 4,538,750 | | 9/1985 | Hanna . | |
| 4,694,979 | | 9/1987 | Ables . | |
| 4,883,206 | * | 11/1989 | Miller | 224/156 X |
| 4,885,812 | | 12/1989 | Lindner . | |
| 4,947,498 | | 8/1990 | Van Boxtel . | |
| 5,209,381 | | 5/1993 | Jay . | |

FOREIGN PATENT DOCUMENTS

| | | |
|---|---|---|
| 172233 | 9/1934 | (CH) . |
| 2228191 | 2/1989 | (GB) . |
| 1602429 | 10/1990 | (SU) . |

* cited by examiner

*Primary Examiner*—Gregory M. Vidovich

(57) ABSTRACT

A backpack which includes a suspension and a frame. The frame includes an inner support structure and an outer support structure releasably connected to each other by quick release pins. The backpack frame can house storage bags and compartments and is adjustably connected to the suspension system by quick release pins. By separating the two support structures, aligning them linearly to each other, and inserting elongated rods between them, a frame for a cot is formed. The orientation of the support structures is such that when a mattress is placed on the frame and weight is put on the mattress, the forces are directed inwardly, resulting in great stability. The suspension can be used as a day pack, i.e. the frame can be eliminated and one of the storage bags can be adjustably attached to the suspension.

7 Claims, 5 Drawing Sheets

BACKPACK FRAME AND COT

BACKGROUND OF THE INVENTION

1. Field of the Invention

The present invention relates to a backpack that converts into a cot.

2. Description of the Prior Art

The present invention is a backpack which includes a suspension and a frame adjustably attached to each other by quick release pins. The backpack frame, which houses numerous storage bags and compartments, includes two support structures which are attached to each other by quick release pins. The support structures of the backpack frame can be realigned to form a frame for a cot. The suspension can be used without the frame and with one of the storage bags as a day pack.

U.S. Pat. Nos. 41,418, issued on Feb. 2, 1864 to Granville Abbott, 2,964,222, issued on Dec. 13, 1960 to Ormon Rainwater, 2,973,888, issued on Mar. 7, 1961 to Harold Beardsley, 3,620,428, issued on Nov. 16, 1971 to John D. Silverthorne, 3,730,407, issued on May 1, 1973 to Winfield Russell, 3,828,992, issued on Aug. 13, 1974 to Joseph Cerchione, 4,056,857, issued on Nov. 8, 1977 to Reginald Quantz, 4,511,071, issued on Apr. 16, 1985 to Richard Curran, 4,538,750, issued on Sep. 3, 1985 to Kenneth Hanna, 4,694,979, issued on Sep. 22, 1987 to Lee Ables, 4,883,206, issued on Nov. 28, 1989 to Irvin Miller, 4,885,812, issued on Dec. 12, 1989 to Charles Lindner, 4,947,498, issued on Aug. 14, 1990 to Leonardus Van Boxtel, 4,955,517, issued on Sep. 11, 1990 to Carlo Maresca, and 5,209,381, issued on May 11, 1993 to John Jay, teach backpacks that convert into seats or cots. However, none of these backpacks has an adjustable suspension or includes a frame that is oriented to give a mattress a great deal of stability.

U.S. Pat. No. 3,464,607, issued on Sep. 2, 1969 to Ernest Grace, teaches a backpack frame and suspension. However, it does not convert to a cot on its own (without the use of a second frame).

U.S. Pat. No. 3,885,722, issued on May 27, 1975 to Jerry Robertson teaches a backpack frame and suspension. However, it does not convert to a cot.

U.S. Pat. No. 3,912,138, issued on Oct. 14, 1975 to Norman Pava, teaches a backpack frame, suspension and plurality of storage bags or compartments, and it can be converted into a litter. However, it differs significantly from the present invention in its geometry and is designed for evacuating injured climbers and hikers, not for sleeping in comfort.

U.S. Pat. Nos. 3,733,017, issued on May 15, 1973 to Murray Pletz, 3,860,157, issued on Jan. 14, 1975 to Peter Richards, 4,169,550, issued on Oct. 2, 1979 to Paul Williams teach backpack frames, suspensions and plurality of storage bags or compartments. However, none of these designs can be converted to a cot.

None of the above inventions and patents, taken either singly or in combination, is seen to describe the instant invention as claimed.

SUMMARY OF THE INVENTION

The instant invention relates to a backpack which includes a suspension and a frame. The frame includes an inner support structure and an outer support structure releasably connected to each other by quick release pins. The backpack frame can house storage bags and compartments and is adjustably connected to the suspension system by quick release pins. By separating the two support structures, aligning them linearly to each other, and inserting elongated rods between them, a frame for a cot is formed. The orientation of the support structures is such that when a mattress is placed on the frame and weight is put on the mattress, the forces are directed inwardly, resulting in great stability. The suspension can be used as a day pack, i.e. the frame can be eliminated and one of the storage bags can be adjustably attached to the suspension.

Accordingly, it is a principal object of the invention to provide a backpack having a frame which can be converted into a cot.

It is another object of the invention to provide a backpack with a frame that can be adjusted with respect to a suspension system.

It is a further object of the invention to provide a backpack in which the suspension system can be used with and adjustably connected to a storage bag and without the weight of the frame.

Still another object of the invention is to provide a backpack that can easily be converted and adjusted by the use of quick release pins.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2B is a perspective cut-away view of the storage compartments of the backpack;

Similar reference characters denote corresponding features consistently throughout the attached drawings.

DETAILED DESCRIPTION OF THE PREFERRED EMBODIMENTS

Figure 1:
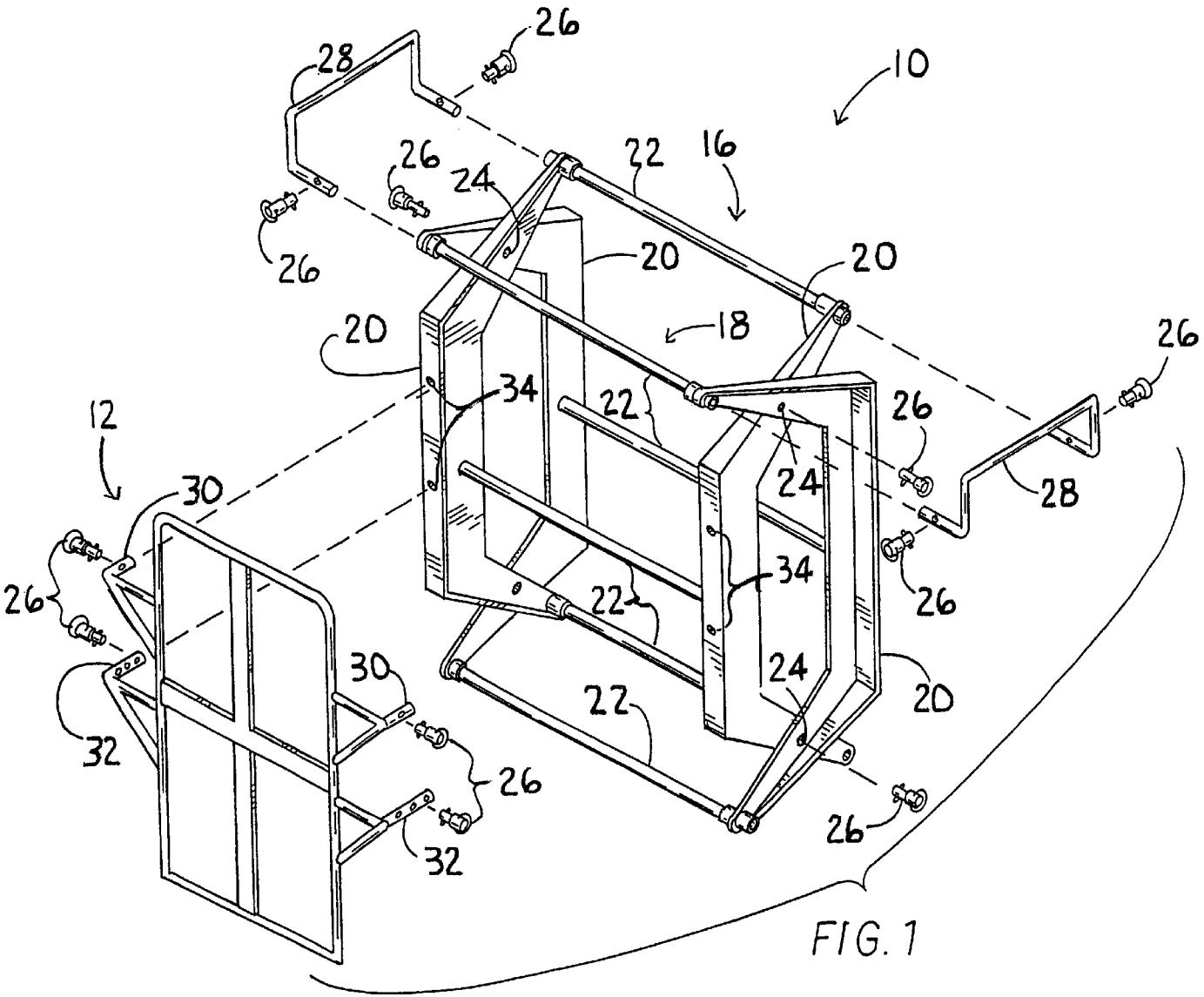
FIG. 1 is an exploded perspective view of the frame and the suspension.
Figure 2A:
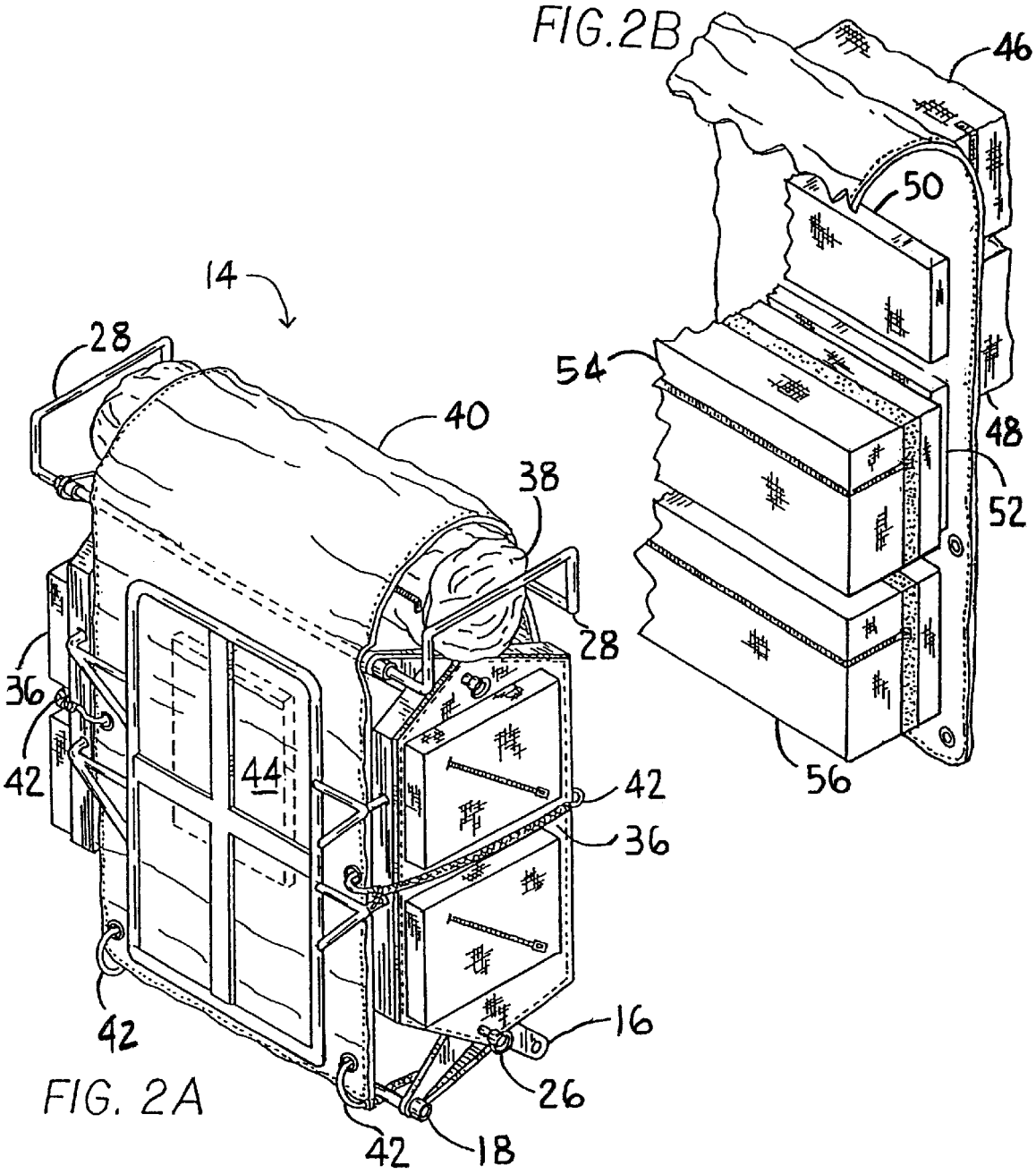
FIG. 2A is a perspective view of the assembled backpack showing the storage compartments.

FIG. 1 shows a frame 10 and a suspension 12 of the backpack 14 (shown fully assembled in FIG. 2A). A shoulder harness (not shown for ease of illustration) is provided on the backpack 14. The frame 10 includes an inner support structure 16 and an outer support structure 18. Both of the support structures 16 and 18 include a pair of flanged C-shaped members 20 connected to each other by three cross members 22 (one each at the top, bottom, and middle of the C-shaped members 20). The C-shaped members 20 may be made of aluminum, plastic, or any other lightweight material. To further reduce their weight, the C-shaped members 20 may have holes.

The inner support structure 16 is fitted inside the outer support structure 18 and holes 24 in the top and bottom of each of the C-shaped member are aligned. The support structures 16 and 18 are attached to each other by quick release pins 26. Handles 28 are attached to the upper part of the support structures 16 and 18 by quick release pins 26. These handles 28 facilitate carrying the pack 14, when it is not worn, and items that cannot fit into the storage bags and compartments (discussed in reference to FIGS. 2A and 2B).

The suspension 12 includes a pair of upper arms 30 and a pair of lower arms 32 that are directed through holes 34 in the inner support structure 16 and fastened with quick release pins 26. The suspension 12 can be adjusted by inserting the pins 26 in one of three holes in the bottom arms 32.

Figure 3:
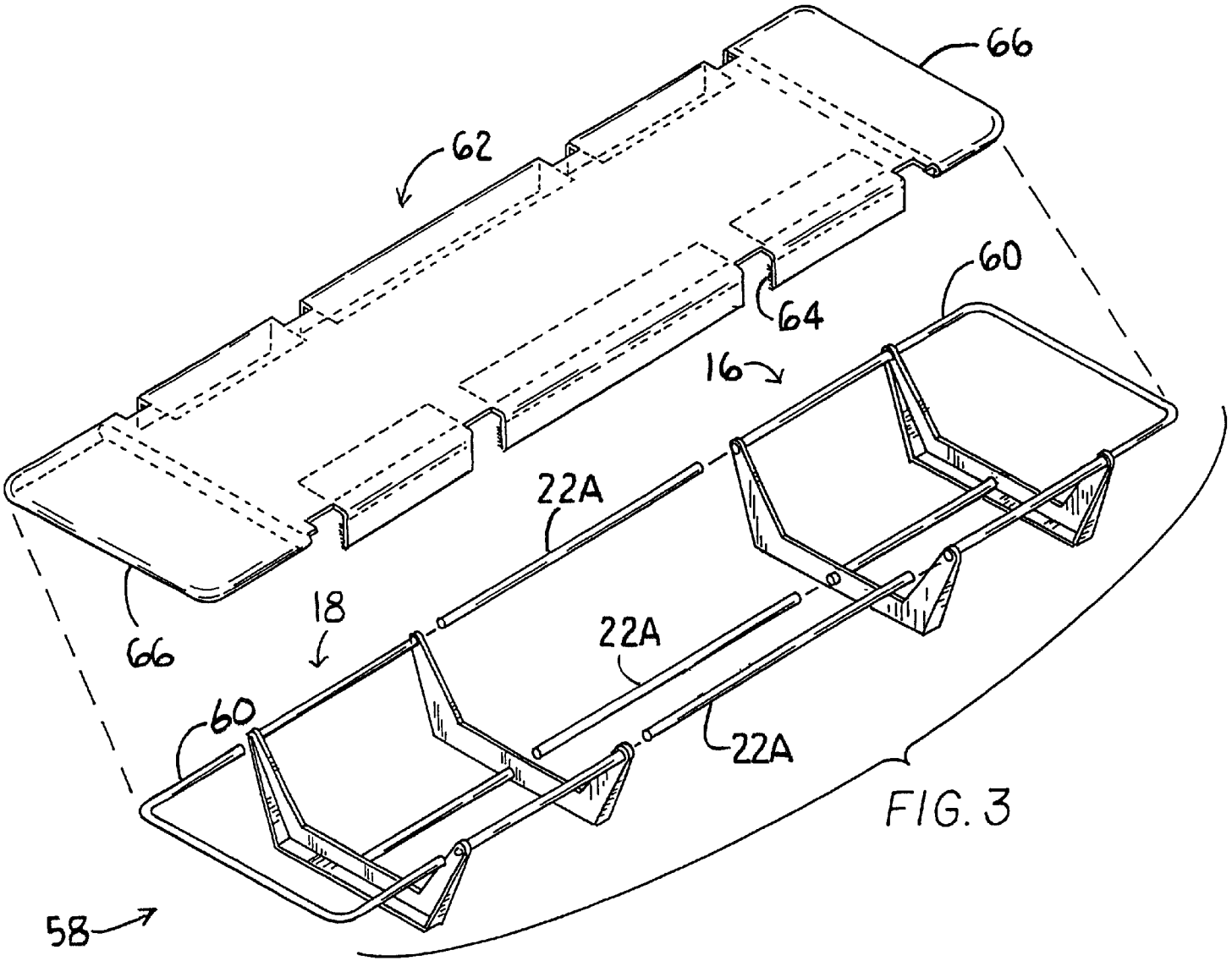
FIG. 3 is an exploded perspective view of the cot frame and mattress.

In FIG. 2A, which shows the pack fully assembled (the harness is not shown for clarity), the side packs 36, the upper pack 38, and the fly 40 are seen. The two packs 36, each of which includes a pair of zippered compartments, are attached to the pack 14 by the quick release pins 26 connecting the two frame support structures 16 and 18 together. The upper pack 38, which stores the additional components required to form a cot (as shown in FIG. 3), rests on the support structures 16 and 18 and is protected by handles 28. The fly 40 is attached to the backpack 14 by bungee cords 42 attached to rivets in the fly 40. The fly 40 includes a compartment 44 for the storage of a grill.

As shown in cut-away view FIG. 2B, the fly 40 also includes storage compartments 46, 48, 50, and 52. The fly 40 is reversible, with one side of it being hunter orange for visibility during hunting season. Zippered storage bags 54 and 56 are also included in the completed backpack 14. These storage bags 54 and 56 may have strips of hook and loop fasteners for attachment to each other and other storage bags (The storage bags have side extensions 70 and 72 as shown on FIGS. 4A and 4B that are tucked out of view in FIG. 2B). This multitude of storage bags and compartments allows for a great deal of organization because related items can be placed in separate compartments.

As seen in FIG. 3, a bedframe 58 is formed by disassembling the backpack 14 and reorienting the support structures 16 and 18. These structures 16 and 18 are oriented linearly and connected by cross members 22A. End pieces 60 are then connected to the opposite ends of the support structures 16 and 18. The cross members 22A, the end pieces 60, and the mattress 62 are stored in the upper pack 38. The mattress 62 is secured onto the cross members 22 and 22A by hook and loop tabs 64. Additionally, pockets 66 at either end of the mattress are placed over end pieces 60. These pockets 66 can be stuffed with clothes to make a pillow or to raise the feet. The resulting cot is very secure because structural integrity is optimized due to stresses directed inwardly by the C-shaped members 20.

Figure 4A:
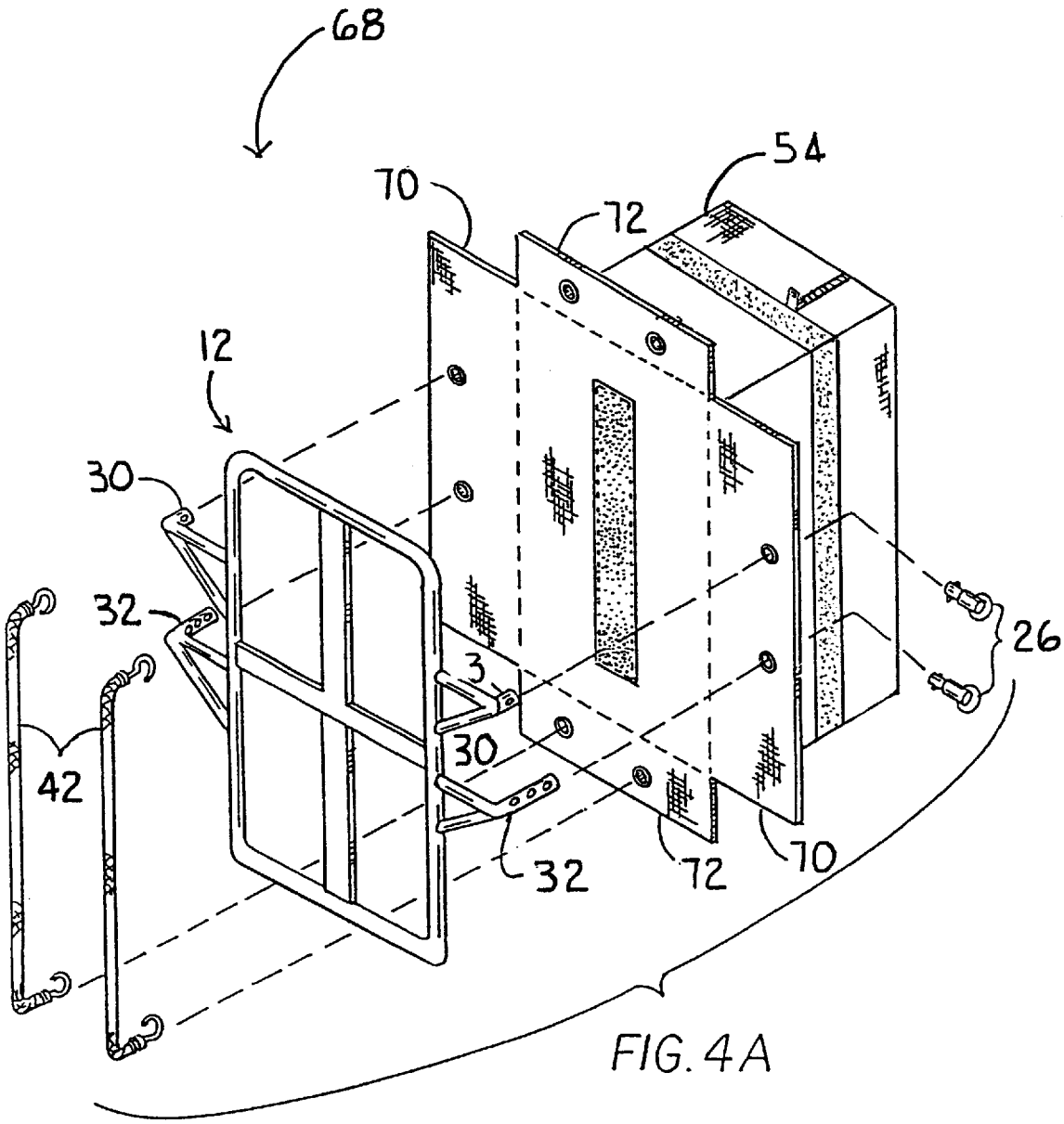
FIG. 4A is a perspective exploded view of the backpack used as a daypack.
Figure 4B:
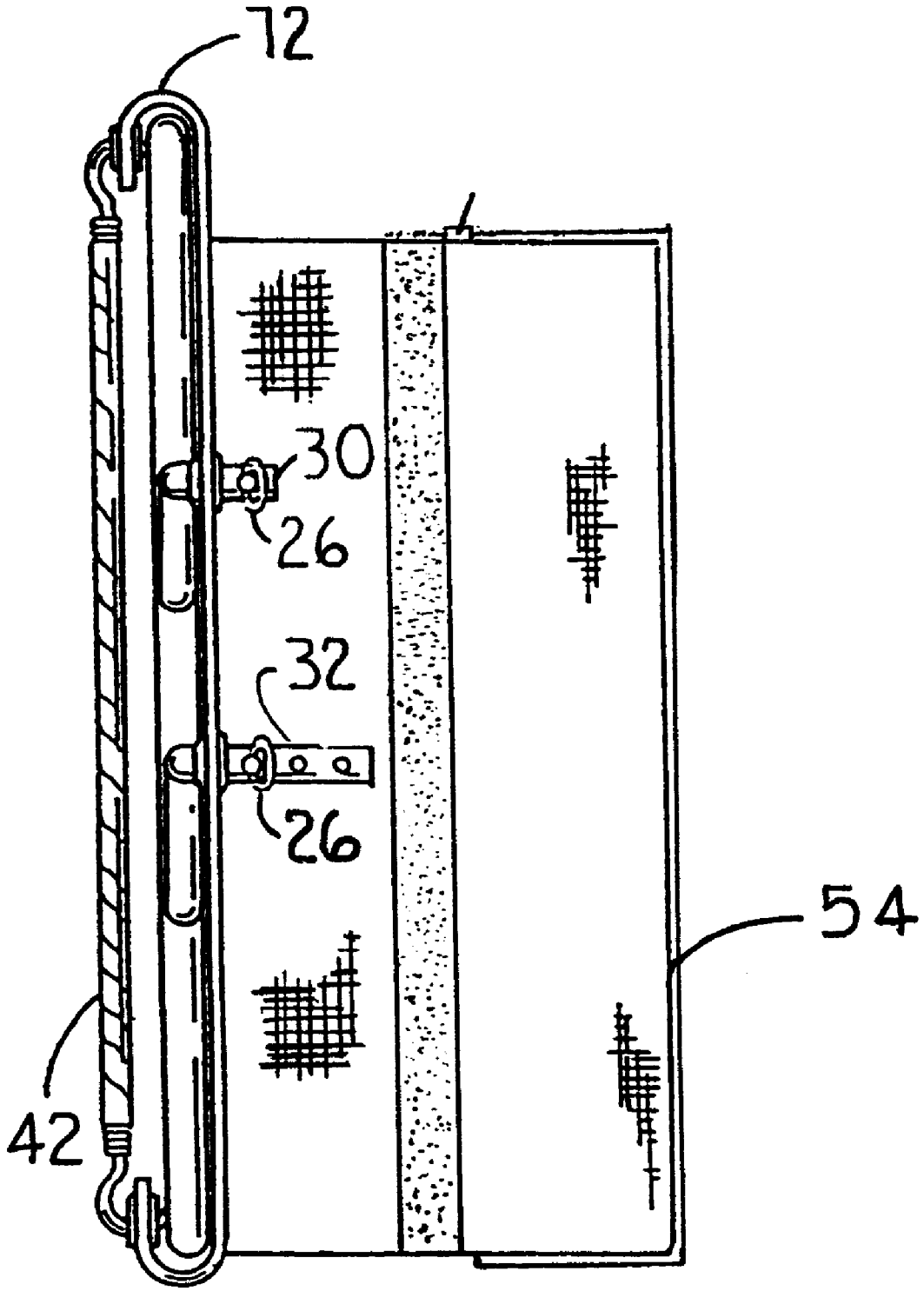
FIG. 4B is a side elevational view of the backpack used as a daypack.

FIGS. 4A and 4B show the suspension 12 used as a daypack 68 with one of the storage bags 54 (Storage bag 54 is rotated 90° and viewed from the opposite view point than shown in FIG. 2B). The arms 30 and 32 are inserted through rivets in side extensions 70 of the storage bag 54 and fastened with quick release pins 26. The suspension can be adjusted by placing the pins 26 in different holes of the arms 32. The bag 54 is further secured by anchoring it to the suspension 12 with bungee cords 42 attached to rivets in upper and lower 72 extensions of the bag 54.

It is to be understood that the present invention is not limited to the sole embodiment described above, but encompasses any and all embodiments within the scope of the following claims.

I claim:

1. A backpack frame comprising:

a. an inner support structure including a pair of vertically-oriented C-shaped members joined by a plurality of cross members, b. an outer support structure, including a pair of vertically-oriented C-shaped members joined by a plurality of cross members each longer than said cross members in said inner support structure, and c. a means for removably attaching said inner support structure to inverted said outer support structure, in a configuration such that the outer support structure overlaps and meshes externally to the inner support structure.

2. The backpack frame of claim 1 wherein said inner support structure is removably attached to said outer support structure by quick release pins.

3. The backpack frame of claim 1 further including a plurality of storage bags and compartments that are located within the outer peripheries of said frame and supported by said frame.

4. The backpack frame of claim 1 further including additional cross members, and said support structures being selectively realigned and combined with said additional cross members to form a cot.

5. The backpack frame of claim 1 further including a suspension which adjustably attaches to said frame.

6. The backpack frame of claim 3 further including a suspension wherein said suspension is adjustably attached to said frame.

7. The backpack frame of claim 3 further including a suspension wherein said suspension is adjustably attached to one of said storage bags when used without said frame.

* * * * *